US005333840A

United States Patent [19]

Sköld et al.

[11] Patent Number: 5,333,840

[45] Date of Patent: Aug. 2, 1994

[54] BLAST PIPE AND TUYERE ARRANGEMENT FOR A BLAST FURNACE AND METHOD

[75] Inventors: Bror E. Sköld, Luleå; Nils O. Lindfors, Gammelstad; Jan O. Wikström, Luleå, all of Sweden

[73] Assignee: SSAB Tunnplåt AB, Borlänge, Sweden

[21] Appl. No.: 91,671

[22] Filed: Jul. 14, 1993

Related U.S. Application Data

[63] Continuation-in-part of PCT/SE92/00026, Jan. 17, 1992.

[30] Foreign Application Priority Data

Jan. 17, 1991 [SE] Sweden ..... 9100143-8

[51] Int. Cl.[5] ..... C21B 7/16

[52] U.S. Cl. ..... 266/47; 266/87; 266/221; 266/225; 266/267; 75/459; 75/460

[58] Field of Search ..... 266/47, 87, 221, 225, 266/267; 75/459, 460, 461

[56] References Cited

U.S. PATENT DOCUMENTS 3,758,090 9/1973 Shimotsuma et al. ..... 266/268
3,832,121 8/1974 Metz et al. .
3,920,230 11/1975 Murphy .
4,490,171 12/1984 Suzuki et al. ..... 266/182
4,921,532 5/1990 Corbett et al. .

FOREIGN PATENT DOCUMENTS 0044096 1/1982 European Pat. Off. .
2265863 10/1975 France .

*Primary Examiner*—Melvyn J. Andrews
*Attorney, Agent, or Firm*—Thomas N. Ljungman

[57] ABSTRACT

Fuel and combustion gas are supplied to the blast pipes and tuyeres of a blast furnace through injection lances which have an inner tube and an outer tube. The inner tube is generally used to carry the fuel, while the space formed between the inner and outer tubes is used to carry the combustion gas. Such a lance can have a heat resistant tip which has a bore for forming an extension of the inner fuel supply tube, and which also has a number of helical channels disposed about the bore for forming an extension of the space between the tubes. It is advantageous to have more than one such lance in each blast pipe and to have the lances extend obliquely into the hot blast channel that is formed by the blast pipe and the tuyere.

27 Claims, 7 Drawing Sheets

BLAST PIPE AND TUYERE ARRANGEMENT FOR A BLAST FURNACE AND METHOD

This application is a continuation-in-part of PCT SE 92/00026 filed Jan. 17, 1992.

BACKGROUND OF THE INVENTION

1. Field of the invention

This invention relates to a blast pipe and tuyere arrangement for a shaft furnace. Such arrangements can have a blast pipe, a tuyere, and a fuel injection lance that can end in either the blast pipe or in the tuyere. A lance for injecting fuel, such as coal, can comprise two concentric tubes, the inner one of which can be configured to supply the fuel, such as coal dust, and the outer one of which can be configured to supply a gas for enhancing combustion, such as oxygen.

2. Background Information

Arrangements having a similarity to the kind described above are known in U.S. Pat. Nos. 4,921,532 and 3,758,090.

OBJECTS OF THE INVENTION

It is an object of the present invention to provide an arrangement of a blast pipe, tuyere, and injector which can provide for a stable combustion for a long period of time. It is also desirable that the arrangement provide for substantially complete combustion and also permit the addition of large amounts of coal.

SUMMARY OF THE INVENTION

To this end, the present invention has several characterizing features which essentially arise from the configuration of the terminal, or injection end of the lance. The lance of the present invention preferably has a heat resistant tip, which forms an extension of the annular space between the concentric tubes of the lance. This tip preferably has a plurality of helical channels disposed in continuity with the annular space, and these channels are separated from and can preferably surround a central fuel, or coal dust supplying channel. Alternately, it is conceivable to form the fuel channel by the annular space and the helical passages, while the central passage can be used for air, but in the context of the present invention, that is for blast furnaces, it is preferable to use the central channel as the fuel channel.

On the end of the tip, at the discharge area of the coal dust and air, it is preferable that the mouth of the coal dust supplying channel be located a distance forwardly of the mouths of the helical channels.

The helical channels can preferably be formed as helical grooves in the outer surface of a tip body. The central coal dust supplying channel can preferably be formed concentrically within the helical grooves. The grooves can then be covered by a sleeve, which in essence can be a continuation of the body of the outer tube.

It is further desirable that the tip body extend forwardly out of the sleeve so that the front edge of the sleeve essentially defines the mouths of the helical channels. In other words, it is preferable that the sleeve essentially only covers a portion of the helical channels, thereby leaving at least the terminal portion of the channels open in a radially outward direction.

The axial position of the outer tube and the inner tube can preferably be maintained fixed relative to one another in the vicinity of the tip of the lance. As such, a device can be provided at the rear end of the tubes to permit relative axial movement between the tubes, and thereby allow for any thermal expansion and contraction which may occur.

Another advantageous feature of the invention provides that a nut be fixed to the front portion of the outer tube and be in threaded connection with a threaded portion of the inner tube so that a simple turning of the inner tube is essentially all that is necessary to adjust the relative axial positions between the outer and inner tubes. Thus, if the tip of the lance is fixed relative to the inner tube, the size of the mouth openings on the exterior of the tip can be adjusted to alter the burning characteristics of the injected material.

With regard to the helical channels, it is preferable that the channels have a pitch angle in the range of about 25° to about 55°, while extending between about 0.5 to about 1.5 full turns around the exterior of the tip.

In an alternative embodiment of the invention, it can be preferable under some burning conditions to use at least two lances for injection of air and fuel. These lances can preferably be arranged so that they are directed obliquely to each other in a manner in which the flames at the tip of each lance collide. Also, when using two or more lances, it can be preferable that the helical channels be arranged in a counter-rotating manner relative to the other. For example, when two lances are used, it can be preferable that one provide a right-handed rotation, while the other provide a left-handed rotation.

In summary, one aspect of the invention resides broadly in a blast furnace having an injection arrangement for injecting at least fuel and gas into the blast furnace. The blast furnace has an exterior wall, and the arrangement comprises a blast pipe, with a tuyere disposed at a first end of the blast pipe to form a blast pipe-tuyere arrangement, the blast pipe-tuyere arrangement defining a first passage therewithin, and the blast pipe-tuyere arrangement being disposed through the wall of the blast furnace for carrying at least hot air into the blast furnace, and a lance device for injecting fuel into the first passage of the blast pipe-tuyere arrangement. The lance device has a first end disposed within the first passage, and the lance device comprises an outer tube, an inner tube, the inner tube being disposed within the outer tube, the inner and outer tubes defining a second passage between the inner and outer tubes, the second passage for conducting a gas into the first passage, the gas being for enhancing combustion in the blast furnace, and the inner tube defining a third passage therewithin, the third passage for conducting fuel into the first passage, and a tip apparatus disposed at the first end of the lance evice. The tip apparatus comprises a longitudinal bore therethrough, the longitudinal bore being disposed to provide a continuation of the third passage, and a plurality of helical passages separated from and disposed helically about the longitudinal bore, the helical passages being disposed to provide a continuation of the second passage.

Another aspect of the invention resides broadly in a lance device for injecting fuel and gas into a first passage of a blast pipe-tuyere arrangement of a blast furnace, the gas being for enhancing combustion of the fuel. The lance device has a first end disposed within the first passage, and the lance device comprises an outer tube and an inner tube, the inner tube being disposed within the outer tube, the inner and outer tubes defining a second passage between the inner and outer tubes, the second passage for conducting the gas into the first passage, the inner tube defining a third passage therewithin, the third passage for conducting the fuel into the first passage, and a tip apparatus disposed at the first end of the lance device. The tip apparatus comprises a longitudinal bore therethrough, the longitudinal bore being disposed to provide a continuation of the third passage, and a plurality of helical passages separated from and disposed helically about the longitudinal bore, the helical passages being disposed to provide a continuation of the second passage.

A further aspect of the invention resides broadly in a method for injecting fuel and gas into a blast pipe-tuyere arrangement of a blast furnace. The blast pipe-tuyere arrangment defining a first passage therewithin, and the gas being for enhancing combustion of the fuel. The blastpipe-tuyere arrangement comprises a lance device for injecting the fuel and gas into the first passage, and the lance device has a first end disposed within the first passage. The lance device comprises an outer tube and an inner tube, the inner tube being disposed within the outer tube, the inner and outer tubes defining a second passage between the inner and outer tubes, the second passage for conducting the gas into the first passage, the inner tube defining a third passage therewithin, the third passage for conducting the fuel into the first passage, and a tip apparatus disposed at the first end of the lance device. The tip apparatus comprises a longitudinal bore therethrough, the longitudinal bore being disposed to provide a continuation of the third passage, and a plurality of helical passages separated from and disposed helically about the longitudinal bore, the helical passages being disposed to provide a continuation of the second passage. The method comprising the steps of: providing the inner and outer tubes of the lance device; configuring the inner and outer tubes to define the second passage between the inner and outer tubes and the third passage within the inner tube; disposing the tip apparatus at the first end of the lance device; providing the longitudinal bore through the tip device; providing the plurality of helical passages in the tip apparatus helically about the longitudinal bore; passing the fuel through the third passage of the inner tube; passing the fuel through the longitudinal passage of the tip apparatus; passing the gas through the second passage between the inner and outer tubes; passing the gas through the plurality of helical passages of the tip element; introducing a swirling motion to the gas by passing the gas through the helical passages; expelling the gas out of the helical passages in a Swirling motion; and expelling the fuel out of the longitudinal passage into the swirling gas.

A still further aspect of the invention resides broadly in a lance device for injecting fuel and gas into a first passage of a blast pipe-tuyere arrangement of a blast furnace. The gas being for enhancing combustion of the fuel, and the lance device having a first end disposed within the passage. The lance device comprises an outer tube and an inner tube, the inner tube being disposed within the outer tube, the inner and outer tubes defining a second passage between the inner and outer tubes, the second passage for conducting the gas into the first passage, the inner tube defining a third passage therewithin, the third passage for conducting the fuel into the first passage; and a tip apparatus disposed at the first end of the lance device. The tip apparatus comprises a longitudinal bore therethrough, the longitudinal bore being disposed to provide a continuation of the third passage, and a plurality of passages separated from and disposed about the longitudinal bore, the plurality of passages being disposed to provide a continuation of the second passage. The tip apparatus has a longitudinal axis. The longitudinal bore of the tip apparatus is disposed along the longitudinal axis. Each of the plurality of passages of the tip element comprises a terminal portion of the second passage, and each of the plurality of passages comprises corresponding mouth portions for expelling the gas into the first cheer. The mouth portions of the plurality of passages are disposed radially with respect to the longitudinal passage of the tip element to disperse the gas radially away from the tip element.

A still further aspect of the invention resides broadly in a lance device for injecting fuel and gas into a first passage of a blast pipe-tuyere arrangement of a blast furnace. The gas is for enhancing combustion of the fuel, and the lance device has a first end disposed within the first passage. The lance device comprises an outer tube and an inner tube, the inner tube being disposed within the outer tube, the inner and outer tubes defining a second passage between the inner and outer tubes, the second passage for conducting the gas into the first passage, the inner tube defining a third passage therewithin, the third passage for conducting the fuel into the first passage, and a tip arrangement disposed at the first end of the lance device. The tip apparatus comprises a longitudinal bore therethrough, the longitudinal bore being disposed to provide a continuation of the third passage, and a plurality of passages separated from and disposed about the longitudinal bore, the plurality of passages being disposed to provide a continuation of the second passage. Each of the plurality of passages comprises a terminal portion of the second passage, and each of the plurality of passages comprises corresponding mouth portions for expelling the gas into the first chamber. The lance device further comprises a device for adjusting a size of at least one of the mouth portions of the plurality of passages to adjust dispersion of the gas expelled therefrom.

BRIEF DESCRIPTION OF THE DRAWINGS

The embodiments of the present invention will be described with reference to the accompanying drawings, in which.

DESCRIPTION OF THE PREFERRED EMBODIMENTS

Figure 1:
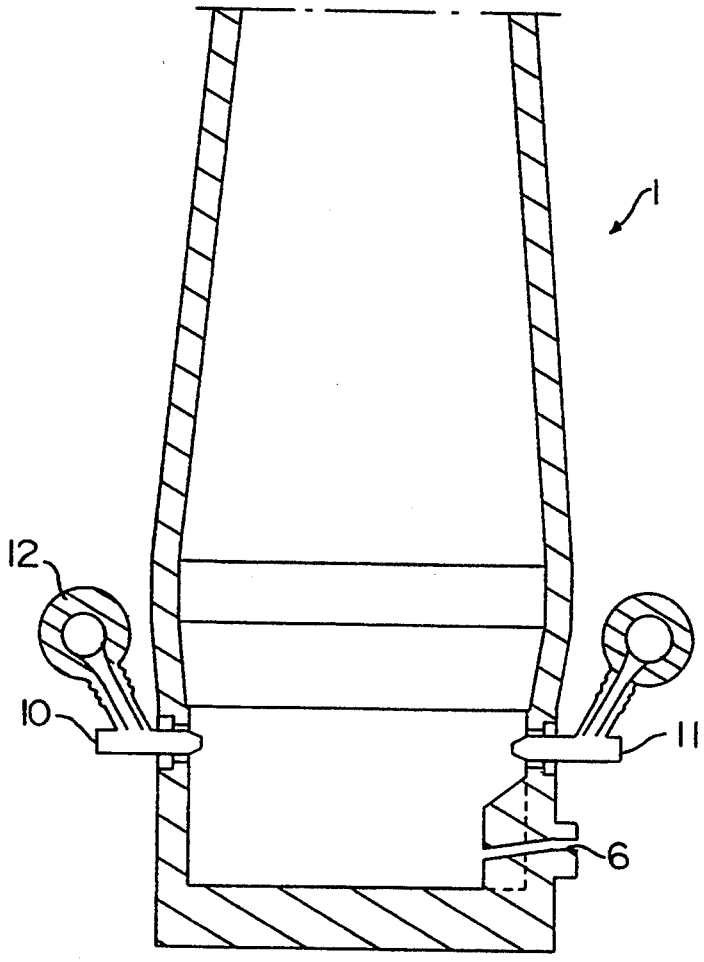
FIG. 1 shows schematically, in a longitudinal section, a blast furnace having blast pipe and tuyere arrangements.

FIG. 1 shows schematically, in a longitudinal section, a shaft furnace 1, which is a type of blast furnace used in smelting ores. Such an arrangement can essentially be termed an "overhead shaft furnace" wherein a burden of ore and, usually, a limited quantity of coke can be added from the top. The furnace 1 can preferably be equipped with blast pipe and tuyere arrangements 10, 11 as shown in the figure. The blast pipe and tuyere arrangements are preferably supplied with hot blast from a circular distributing pipe 12. Also, by means of the blast pipe and tuyere arrangements, a combination of oxygen and fuel, such as coal, can be injected into the furnace, to burn in the furnace to smelt the ore and produce iron. The iron can then be tapped at the bottom opening 6.

Figure 2:
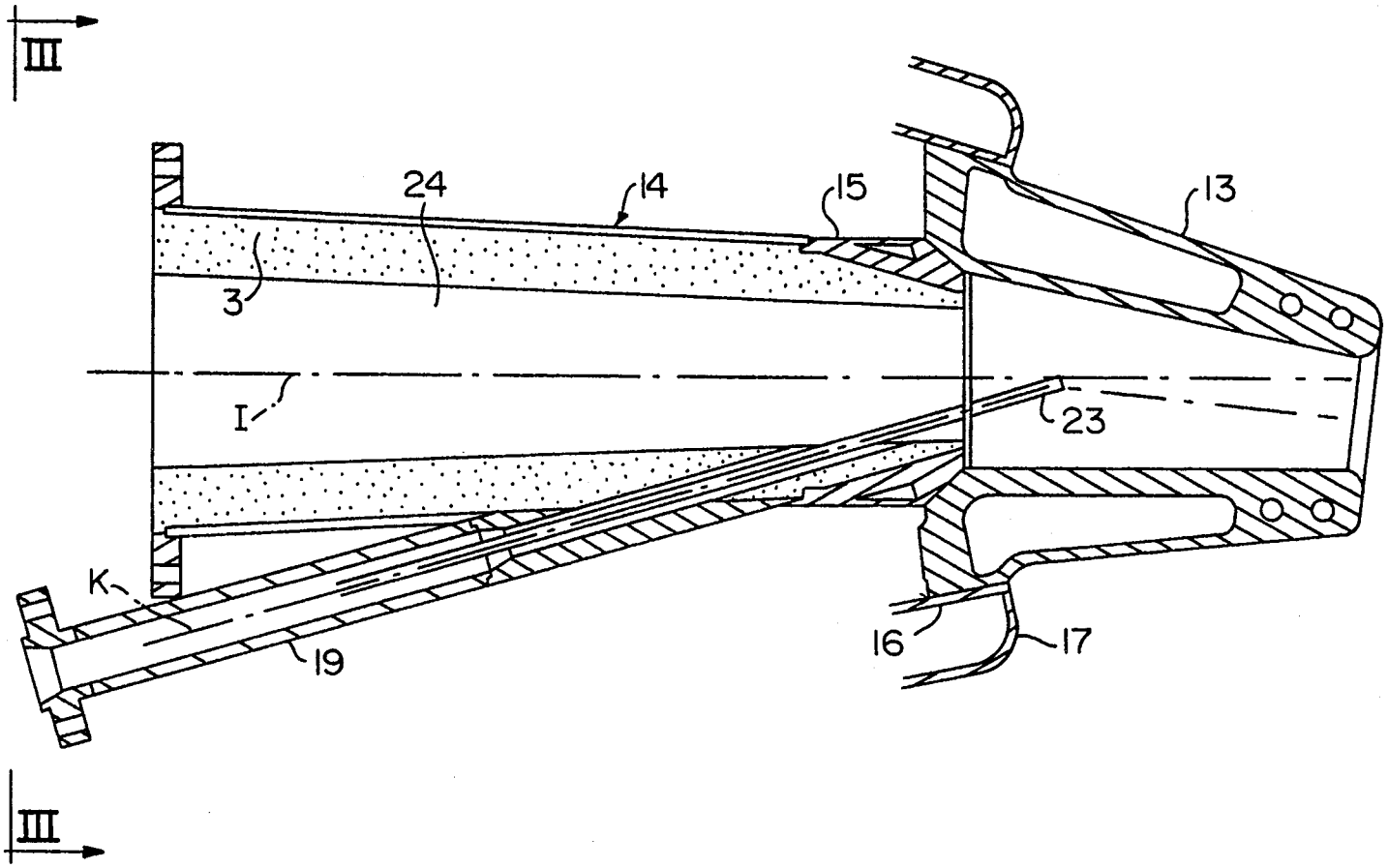
FIG. 2 shows an enlarged view, in a longitudinal section, of a portion of one of the blast pipe and tuyere arrangements as shown in FIG. 1.

A blast pipe-tuyere arrangement 10, 11 of FIG. 1 is shown in greater detail in FIG. 2, wherein the tuyere 13 and the blast pipe 14 are shown. In a conventional embodiment, the blast pipe 14 essentially has a ceramic-lined steel tube 3 and a water-cooled copper jacket 15 to which the tuyere 13 can be affixed. The tuyere 13 can be made of copper and can also be water-cooled, as is conventional. The tuyere 13 preferably has a conical surface 16 for sealing against a water-cooled copper jacket 17 in the blast furnace wall. The blast pipe 14 and the tuyere 13, together, form a hot blast channel 24. If desired, the tuyere 13 does not necessarily have to be configured symmetrically with the blast pipe 14, but can conceivably point a few degrees downwardly, as shown. Under some conditions, it may be desirable to make the tuyere symmetrical.

As shown in FIG. 2, the blast pipe 14 can preferably have at least one tube 19 extending thereinto obliquely through the wall of the blast pipe 14. A coal injection lance 23 can be disposed through the tube 19 into the hot blast channel 24. Alternatively, as shown in FIG. 3, which is an end view of the blast pipe 14, at least two such tubes 18, 19 can extend as channels obliquely through the wall of the blast pipe 14, and two corresponding coal injection lances 22, 23 can extend through the tubes 18, 19 into the hot blast channel 24.

Figure 3:
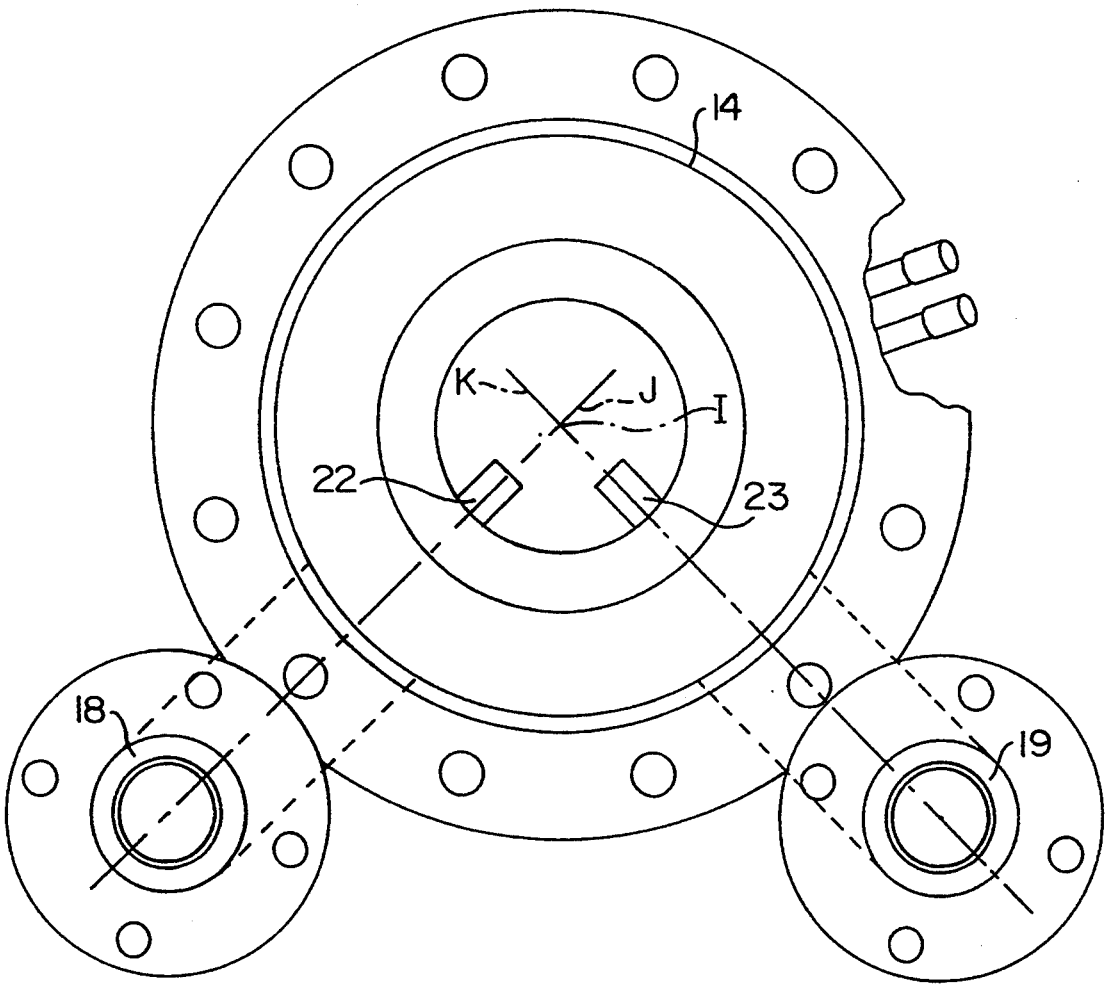
FIG. 3 is an end view of the blast pipe and tuyere arrangement taken along line III—III in FIG. 2.

As shown in FIG. 3, in accordance with a preferred embodiment of the invention, the two tubes 18, 19 can preferably be disposed in two planes which pass through the longitudinal axis I of the blast pipe 14. In this figure, the longitudinal axis I essentially runs into the page. The tubes 18 and 19 are preferably disposed so that the longitudinal axes J, K of the lances 22, 23 preferably intersect the axis I of the blast pipe 14 at a common point. In FIG. 3, the tubes 18, 19 are shown at right angles to each other, as seen in a plane transverse to the blast pipe 14. This angle, however, may not be the optimum angle, and under many conditions, the optimum angle has been found to be in the range of from about 150° to about 180°. In essence, the tubes can be disposed at almost any angle with respect to one another, even though such angles may not necessarily provide for optimum combustion. In FIG. 3, only the front end portions of the lances 22, 23 are shown, while the rear ends are not shown.

Figure 4:
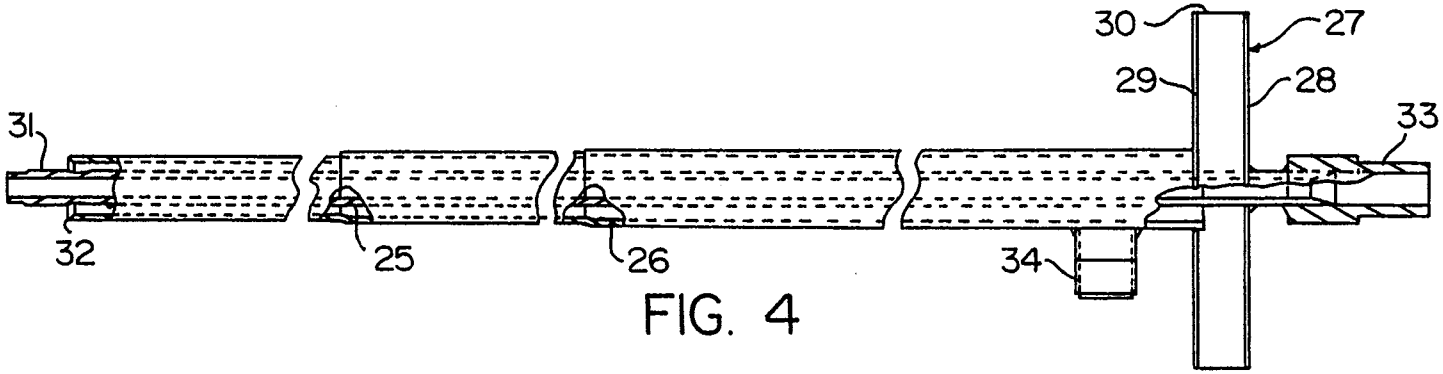
FIG. 4 shows, in a longitudinal section, a coal injection lance as is schematically indicated in FIG. 2, with the tip of the lance removed.

A lance without its tip is shown in FIG. 4. The lance can preferably be formed by two concentric tubes 25, 26 that can preferably be coupled together at their rear ends by means of a resilient compensator 27. Such a resilient compensator 27 can preferably be formed by two springy, or flexible, steel plates 28, 29 which are preferably welded to a mantle 30. One of the steel plates can be welded to the inner tube 25 and the other can be welded to the outer tube 26. For example, the inner tube 25 can be welded to the plate 28, while the outer tube 26 can be welded to the plate 29.

The front end of the inner tube 25 preferably has an outer thread 31, and the front end of the outer tube 26 preferably has a conical surface 32. At the rear end, the inner tube 25 can have a fitting 33 for receiving the fuel, which in this case can preferably be a coal dust suspension (such as coal dust suspended in air), and the outer tube 26 can have a fitting 34 for receiving a gas for enhancing combustion, such as oxygen. Alternatively, as discussed previously, it might be conceivable that the feeds of the gas and the fuel can be reversed for use of such an arrangement in possible alternative processes.

Figure 5:
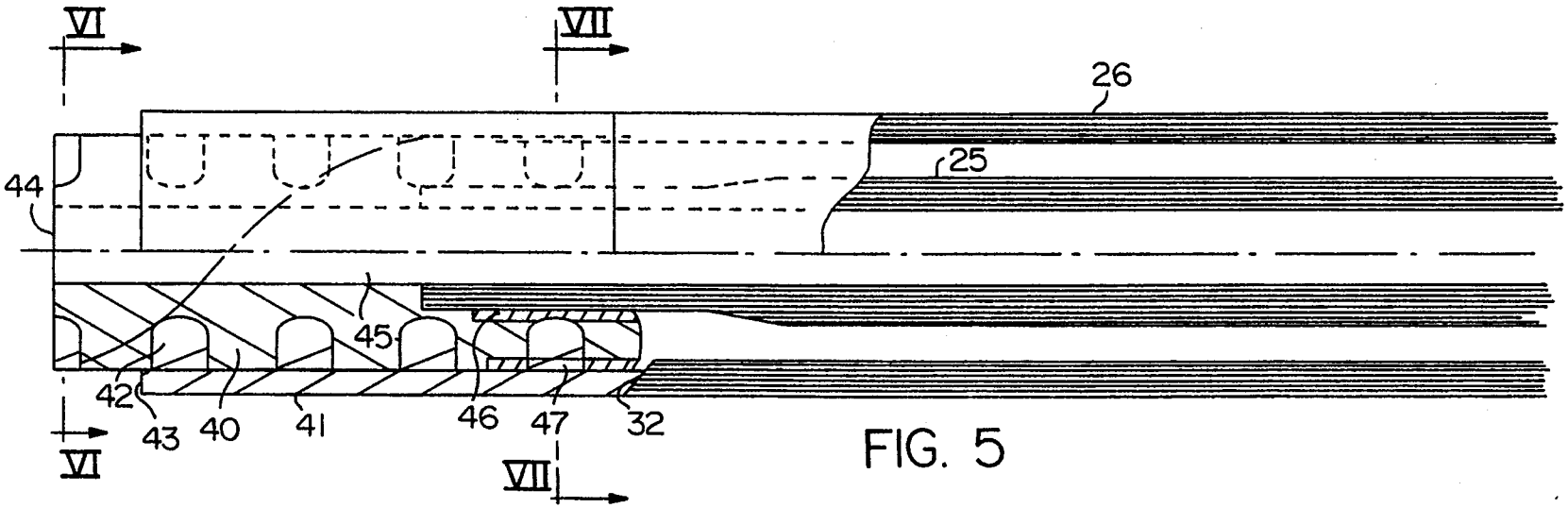
FIG. 5 shows, enlarged, partly in view and partly in a longitudinal section, the front portion of the coal injection lance shown in FIG. 2.

In FIG. 5, the front end of the lance shown in FIG. 4 is shown with a tip mounted thereto. The tip of the lance, as shown in FIGS. 5–8, can preferably be formed by a body 40 of a heat resistant material. This tip can be connected to the lance by means of the threaded portion 46, wherein the tip can be screwed onto the inner tube 25 to be affixed thereto. Alternately, other forms of attachment can possibly be used, such as a form of snap-fit connector.

In the particular embodiment shown in FIG. 5, the inner tube 25 has a length which is longer than the length of the outer tube 26. With such an embodiment, the outer tube 26 can then essentially be extended by means of a sleeve 41 which can be attached to the body 40 of the tip. This sleeve 41 can preferably be screwed onto the body 40 by means of the threaded portion 47, before the body 40 is screwed onto the inner tube 25. Then, when the body 40 is affixed to the inner tube 25, the sleeve 41 can be screwed to abut with its conical end surface against the conical end surface 32 of the outer tube 26. In this manner, the resilinet compensator 27 can be prestressed to secure a tight seal between the outer tube 26 and the sleeve 41. By prestressing the compensator 27, a good seal can essentially be maintained, even under conditions when the longitudinal thermal expansion of the inner tube 25 and the outer tube 26 differs.

The tip 40 and sleeve 41 of the lance can, for example, be made of heat resistant stainless steel or the tip 40 and sleeve 41 can be made of a heat resistant machinable sinter metal. Alternatively, the tip 40 and sleeve 41 can be made of a ceramic.

Figure 6:
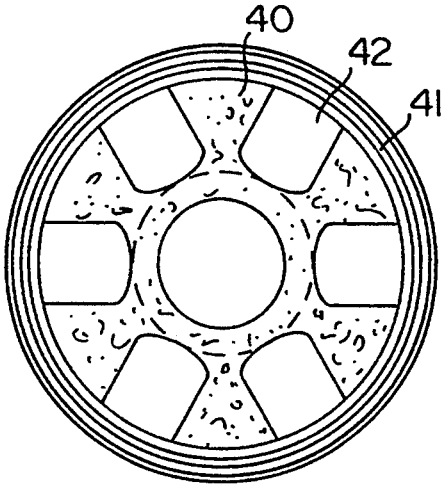
FIGS. 6 and 7 are transverse sections taken along the lines VI—VI and VII—VII, respectively, in FIG. 5.
Figure 7:
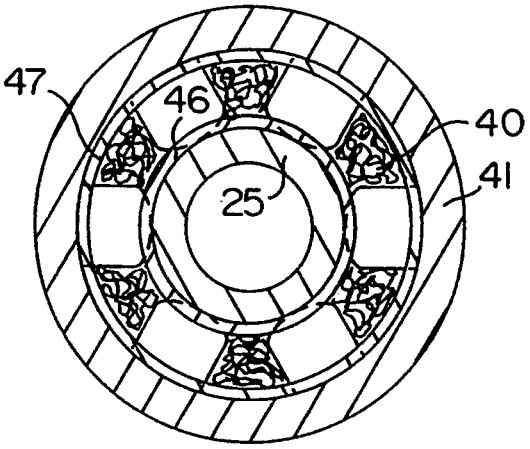
Figure 8:
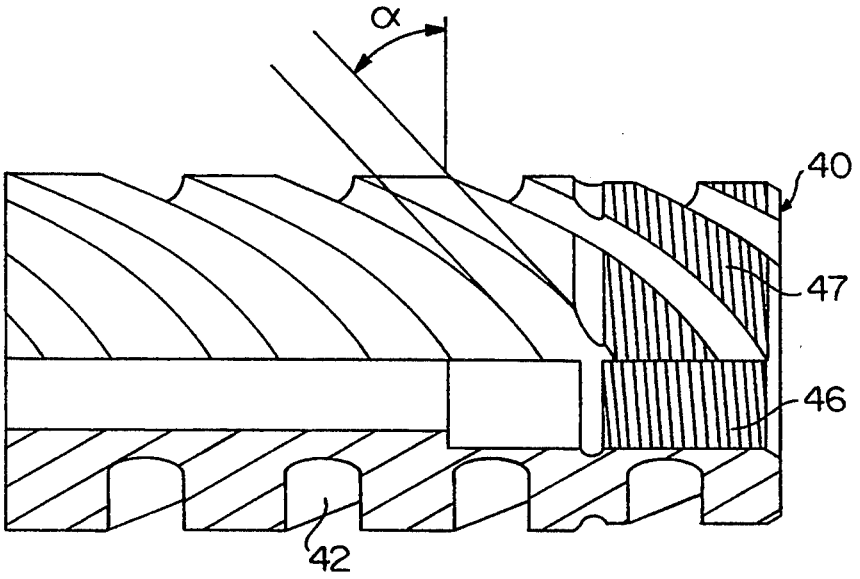
FIG. 8 shows, partly in view and partly in section, one of the two parts that form the tip of the lance shown in FIG. 5.

Preferably, a longitudinal central channel 45 in the body 40 can form an extension of the inner passage of the inner tube 25. The channel 45 can terminate at a mouth 44. The body 40 can preferably have a plurality of helical grooves 25 in its outer cylindrical surface. In the illustrated embodiment, as shown in FIGS. 6 and 7, there are preferably six grooves 42. As shown in FIG. 8, the pitch angle (alpha) of the grooves should preferably be in a range of about 25° to about 55°. FIG. 8 shows one possible angle selection of about 45°. It is preferable that the body 40 with its grooves 42 extends forwardly out of the sleeve 41. The front edge 43 of the sleeve 41 thereby essentially defines the limits of the mouths of the helical channels formed by the grooves 42 extending out of the sleeve 41. When the grooves carry oxygen, for example, the oxygen can then expand radially when it passes the front edge 43 of the sleeve 41. It is also preferable that the body 40 should extend forwardly of the front edge 43 of the sleeve so that the mouth 44 of the coal dust channel 45 can be located a distance forwardly of the mouths of the oxygen channels 42. Typically, the position of the front edge of the body 40 could be in a range of about 5 to about 15 mm forwardly of the front edge of the sleeve 43, or the mouths of the oxygen channels 42.

It is preferable that as great a pressure drop of the oxygen as possible should take place at the outlet. Thus, the helical channels 42 should therefore not be longer than about one-and-a-half full turns about the body 40, as longer channels tend to result in a greater pressure loss therewithin. It is more preferable if the channels 42 are about one full turn, or even less. They should, however, typically not be shorter than about one-third of a full turn in order to ensure a proper rotation of the oxygen.

Typically, the diameter of the tip body 40 can be in a range of between about 20 to about 30 mm, while the entire length of the lance can be about 2 m. With lance tips as shown and illustrated there will generally be stable lighting, stable rotation and stable combustion. The coal dust will typically burn completely in the raceway, or channel 24. That is, complete combustion of any injected coal dust would essentially occur in about 4 to about 6 milliseconds, even at high coal injection levels. The oxygen in the outer tube 26 can cool the inner tube 25 so that air can be used as a carrier of the coal dust. Also, if necessary, the oxygen rate, or content, of the carrier air may be reduced by the addition of nitrogen to the carrier air.

Figure 10A:
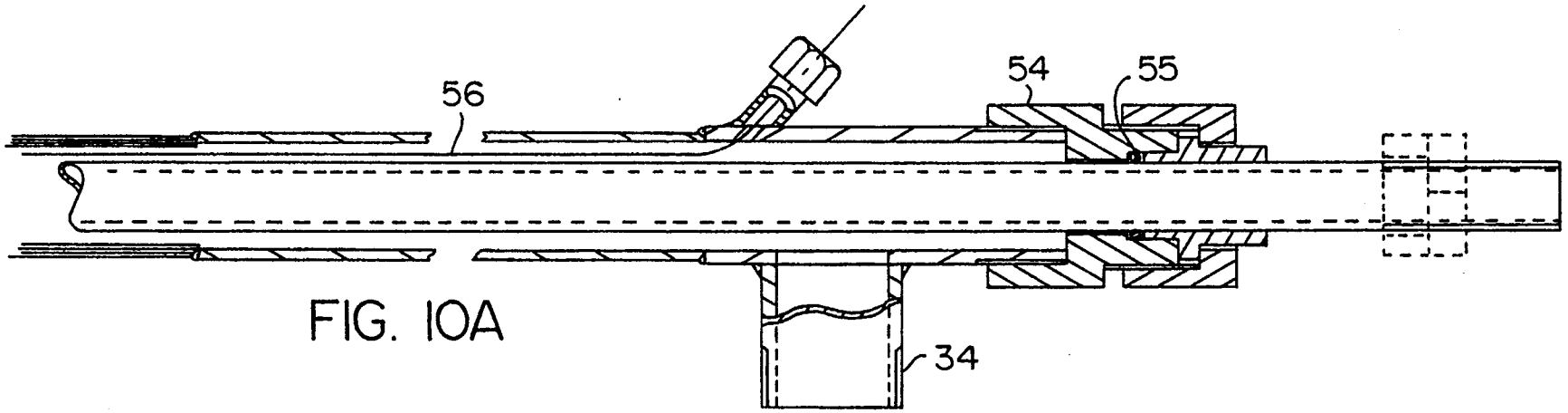
FIGS. 10A and 10B show, together, a modified design of a lance.
Figure 11:
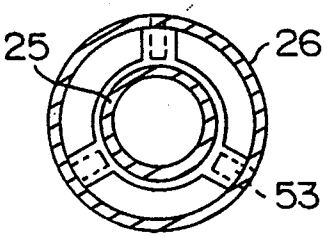
FIG. 11 is a section taken along lines XI—XI in FIG. 10B.
Figure 10B:
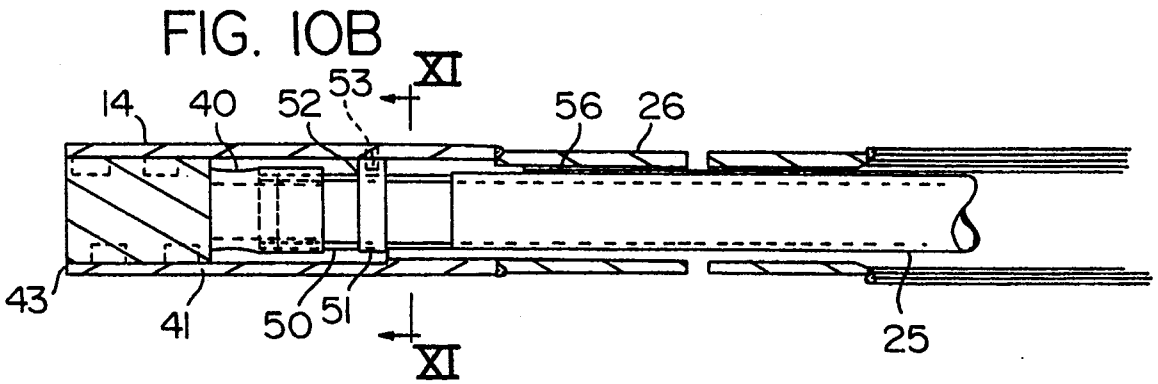

FIGS. 10A, 10B and 11 show, in accordance with another preferred embodiment of the present invention, an alternative design of a lance. FIG. 10A shows the rear end of a lance, and FIG. 10B shows the front end. Parts in FIGS. 10A, 10B and 11 that correspond to essentially similar parts in the previous figures have been given the same numerals as given in the previous figures. In this embodiment, the tip body 40 can be screwed onto the inner tube 25 as in the previous embodiment. In this embodiment, however, there is essentially no need for a sleeve 41, as the outer tube 26 preferably extends forwardly to a greater degree, in comparison to the previous embodiment.

The outer tube can preferably have a sliding fit to the tip body 40. The threaded portion 50 of the inner tube 25 can preferably extend rearwardly and can be in threaded engagement with a nut 51 that preferably has three legs 52 that can be affixed to the outer tube 26, such as by means of screws 53. At the rear end of the lance there can preferably be a sliding connection 54 with an O-ring 55 on the outer tube 26, through which O-ring 55 the inner tube 25 preferably extends. Thus, at the rear end of the lance, as shown in FIG. 10A, the inner tube 25 can preferably project from the end of the outer tube 26. Thus, as a result of the threaded connection between the inner tube 25 and the nut 51, a simple turning of the inner tube 25, at the rear end thereof, can allow for adjustment of the axial position of the tip body 40 relative to the front edge 43 of the front portion 41 of the outer tube 26.

If the coal suspension is supplied to the inner tube 25 through a swivel coupling, or a coupling which possibly allows the coal supply to remain stationary while the inner tube is turned, such an adjustment of the axial position of the tip body 40 can even be made during operation of the blast furnace. Thus, the efficiency of burning of the coal dust can essentially be optimized without requiring the entire assembly to be removed, or even shut down, which, in the past, may have resulted in decreased operating efficiency of a furnace having a coal dust injection arrangement.

Any differences in thermal expansion between the tubes 25, 26 can essentially be taken up as a sliding movement in the sliding connection 54 at the rear end of the lance. Thus, thermal expansion essentially should not change the axial position of the tip body 40 with respect to the front edge 43 of the outer tube. In this respect, there is essentially no difference between the lance of the embodiment as depicted in FIGS. 10A, 10B, and 11, and the previously described lance of FIGS. 4 and 5. In other words, in both embodiments, the two tubes 25, 26 can be fixed relative to each other at their front ends.

With the lance of FIGS. 10A, 10B and 11, however, as compared to the lance of FIG. 5, the axial position of the tip body 40, relative to the edge 43 of the outer tube 26, can be adjusted when the lance is in its operative position. Thus, with the alternative embodiment of FIGS. 10A, 10B, and 11, as discussed above, one can essentially make fine adjustments of the flame by turning the inner tube while the flame is burning, for example, if such a change becomes necessary under situations when the quality of the coal dust may change. This adjustment arrangement also permits for adjustment of the relative positioning of the tip body 40 and edge 43, when the lance tip body 40 or the edge 43 of the outer tube 26 has been eroded. In FIG. 10B, the front surface of the tip body 40 is shown flush with the front edge 43 of the outer tube 26, but the threaded portion 50 of the inner tube 25 permits for a wide range of axial adjustment.

Further, this arrangement also make possible a more economical replacement of parts when parts become worn out. For example, when the tip of the lance is worn out, the damaged front portion of the outer tube 26 can be cut off, a new tip body 40 can be screwed onto the inner tube 25 and a new front piece 41 of the outer tube can be welded to the remaining outer tube 26. Thus, such a new front piece of the outer tube 26 would essentially correspond to the sleeve 41 in FIG. 5. Thus, a combination of the concepts of each of the first embodiment of FIG. 5, with a threadable sleeve that is threadable onto the outer tube 26, and a tip body 40 which could be threaded thereinto, as in the latter embodiment of FIGS. 10A, 10B and 11, could also be possible, thereby avoiding any additional expense of welding new ends onto the outer tube.

FIG. 10A also illustrates a manner in which the temperature of the lance can be monitored. As shown, the temperature in the annular space between the tubes 25 and 26 can be measured with a thermoelement 56.

When using such lances as described above, it is generally advantageous to have more than one lance in each blast pipe and to have the flames collide. For example, two lances can preferably be disposed as shown in FIG. 3. When, for example, two lances are used, it is generally preferable that the lance tips should have their grooves helical in opposite directions so that the flames will be counter-rotating, thereby further enhancing the combustion.

The combustion can still further be improved when the lance tips are disposed at an angle to each other and to the center axis of blast pipe 14, as illustrated in FIG. 3, instead of being arranged parallel to each other and to the axis of the blast pipe. The lances can be considerably better supported when they extend obliquely through the wall of the blast pipe 14 instead of extending longitudinally through the entire blast pipe. Further, the risk of lance tip vibration due to dynamic forces can also be reduced by mounting the lances to extend obliquely through the wall, which is advantageous per se, but is also advantageous to the combustion.

Figure 9:
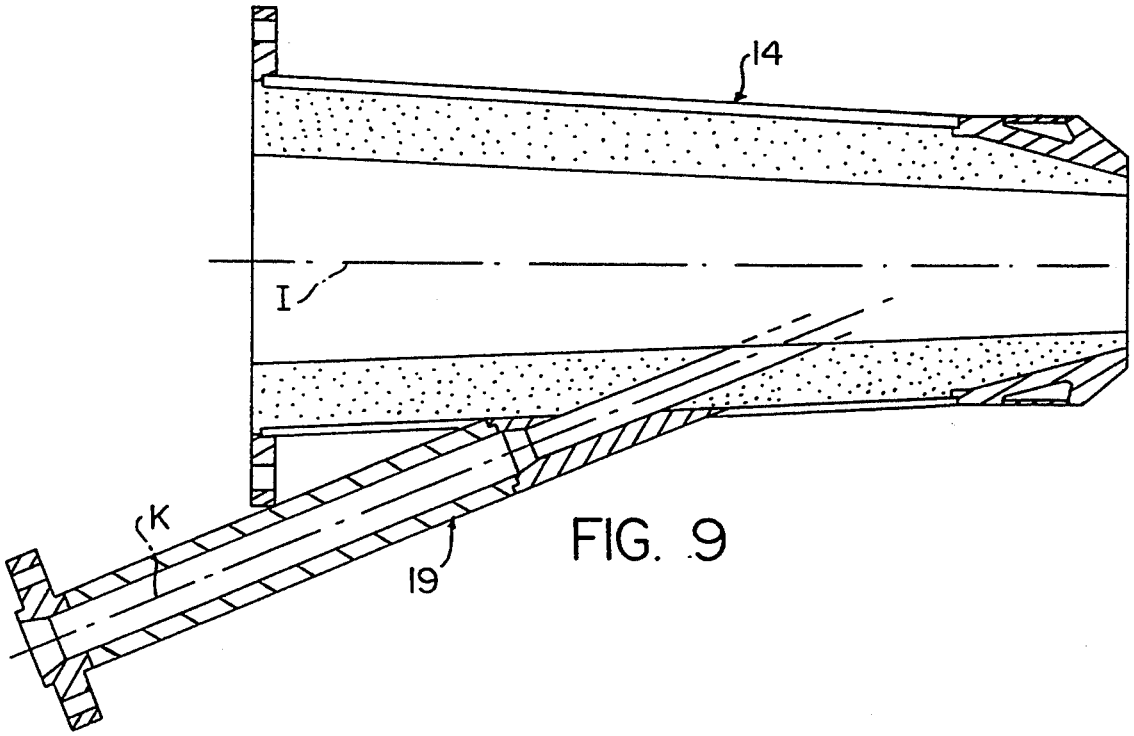
FIG. 9 shows a similar view as shown in FIG. 2, with a modified positioning of the lance.

FIG. 9 shows, in accordance with another preferred embodiment of the present invention, a modified design of the blast pipe 14. The tube 19, in this configuration, is displaced rearwardly so that the lance 23 ends in the blast pipe 14 instead of in the tuyere 13 as in the previous figures. It would also be possible to have the lances extend through the wall of the tuyere 13 instead of through the wall of the blast pipe 14. In such a configuration, the lance tips are essentially displaced forwardly so that the combustion will not inordinately heat the tuyere. Consequently, less heat need be conveyed from the tuyere by the cooling water.

All the blast pipes 14 can suitably be provided with coal injection lances, but in certain cases it can be desirable to provide only some, and not all, of the blast pipes with coal injection lances.

One feature of the invention resides broadly in the blast pipe and tuyere arrangement for a shaft furnace, comprising a blast pipe 14, a tuyere 13, and a coal injection lance 23 that ends in the blast pipe or in the tuyere, the lance 23 comprising two concentric tubes 25, 26, the inner one of which 25 is arranged to supply coal dust and the outer one of which 26 is arranged to supply oxygen, characterized in that the lance 23 comprises a heat resistant tip 40, 41 that forms an extension of the annular space between the tubes 25, 26 in the form of a number of helical channels 42 that are separated from and surround a central coal dust supplying channel 45, 44.

Another feature of the invention resides broadly in the arrangement, characterized in that the mouth 44 of the coal dust supplying channel 45 is located a distance forwardly of the mouths of the helical channels 42.

Yet another feature of the invention resides broadly in the arrangement, characterized in that said helical channels are formed as helical grooves 42 in the outer surface of a tip body 40 in which said central coal dust supplying channel 45 is formed, the grooves 42 being covered by a sleeve 41.

Still another feature of the invention resides broadly in the arrangement, characterized in that said tip body 40 extends forwardly out of said sleeve 41 so that the front edge 43 of the sleeve defines the mouths of the said helical channels 42.

Still yet another feature of the invention resides broadly in the arrangement, characterized in that the axial position between the outer tube 26 and the inner tube 25 is fixed adjacent the tip 40, 41 of the lance, and a device 27, 54 is arranged at the rear end of the tubes to permit relative axial movement between the tubes 25, 26.

Another feature of the invention resides broadly in the arrangement, characterized in that a nut 51 is fixed to the front portion of the outer tube 26 and is in connection with a threaded portion 50 of the inner tube 25 so that turning of the inner tube 25 will adjust the relative axial positions between the outer and inner tubes 25, 26.

Still another feature of the invention resides broadly in the arrangement, characterized in that said helical channels have a pitch angle in the interval of 25°–55°.

Yet another feature of the invention resides broadly in the arrangement, characterized in that the helical channels extend 0.5–1.5 full turns.

Still yet another feature of the invention resides broadly in the arrangement, characterized in that there are at least two lances 22, 23 and the lances are directed obliquely to each other, so that their flames collide.

Another feature of the invention resides broadly in the arrangement, characterized in that there are two lances 22, 23, one of which has its helical channels 42 counterrotating relative to the other.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. In a blast furnace, an injection arrangement for injecting at least fuel and gas into the blast furnace, the blast furnace having an exterior wall, the arrangement comprising:

a blast pipe;

a tuyere disposed at a first end of the blast pipe;

the blast pipe and tuyere forming a blast pipe-tuyere arrangement;

the blast pipe-tuyere arrangement defining a first passage therewithin, and the blast pipe-tuyere arrangement being disposed through the exterior wall of the blast furnace for carrying at least hot air into the blast furnace;

lance means for injecting fuel into the first passage of the blast pipe-tuyere arrangement, said lance means having a first end disposed within said first passage; and said lance means comprising:

an outer tube and an inner tube, the inner tube being disposed within the outer tube;

said inner and outer tubes defining a second passage between said inner and outer tubes, said second passage for conducting a gas into said first passage, the gas being for enhancing combustion in the blast furnace;

said inner tube defining a third passage therewithin, said third passage for conducting fuel into said first passage;

tip means disposed at said first end of said lance means; and said tip means comprising:

a longitudinal bore therethrough, said longitudinal bore being disposed to provide a continuation of said third passage; and a plurality of helical passages separated from and disposed helically about said longitudinal bore, said helical passages being disposed to provide a continuation of said second passage.

2. The injection arrangement according to claim 1, wherein:

said inner tube has a first end disposed adjacent said tip means;

said tip means has a first end disposed adjacent the first end of said inner tube, and a second end disposed opposite to the first end of said tip means;

said longitudinal bore comprises a mouth portion for expelling the fuel into said first passage, said mouth portion of said longitudinal bore being disposed at a first distance from said first end of said tip means;

said plurality of helical passages comprise a terminal portion of said second passage, each of said plurality of helical passages comprising corresponding mouth portions for expelling the gas into said first passage, said mouth portions of said helical passages being disposed at a second distance from said first end of said tip means; and said first distance being greater than said second distance.

3. The injection arrangement according to claim 2, wherein:

said tip means comprises a one-piece tip body;

said longitudinal bore passes through said one-piece tip body;

said one-piece tip body has an exterior surface; and said helical passages comprises helical grooves disposed helically about said exterior surface of said one-piece tip body.

4. The injection arrangement according to claim 3, wherein said helical grooves extend helically about said tip means through about 0.5 to about 1.5 turns.

5. The injection arrangement according to claim 4, wherein:

said inner tube is disposed concentrically within said outer tube;

said second passage comprises an annular space between said inner and outer tubes;

said one-piece tip body comprises a heat resistant material;

said longitudinal bore is configured for being substantially aligned with said third passage;

said plurality of helical grooves disposed concentrically about said longitudinal bore;

said plurality of helical grooves comprise six helical grooves disposed in a spaced apart relationship about the exterior surface of said tip body;

the fuel comprises coal dust;

the gas comprises oxygen;

said lance means further comprises:

means for connecting said third passage to a coal dust supply source; and means for connecting said second passage to an oxygen supply source;

said tip means further comprises sleeve means for being disposed about said one-piece tip body;

said outer tube having a first end disposed adjacent said sleeve means, and said sleeve means providing a continuation of said outer tube;

said sleeve means having an interior surface disposed in contact with said exterior surface of said tip body;

said helical grooves being bordered by said interior surface of said sleeve means;

said sleeve means having a first end disposed away from said outer tube;

said tip body and said helical grooves extending a distance out of said first end of said sleeve means to define said mouth portions of said helical passages;

said mouth portions of said helical grooves being disposed in a radial direction away from said tip body;

said lance means comprises, adjacent said first end thereof, means for maintaining the first end of said inner tube in a substantially fixed position with respect to the first end of the outer tube;

said lance means has a second end opposite to said first end of said lance means, and said lance means further comprises, adjacent said second end thereof, means for allowing relative axial expansion of said inner and outer tubes;

said means for allowing relative expansion comprising:

a first steel plate welded to said inner tube;

a second steel plate spaced apart from said first steel plate and welded to said outer tube;

a mantle disposed between and connecting said first steel plate and said second steel plate, said mantle being spaced a distance radially away from said inner and outer tubes;

said sleeve means is fixedly attached to said outer tube by one of:

a weld between said sleeve means and said outer tube; and threaded portions, wherein each of said outer tube and said sleeve means comprises corresponding threaded portions for threading said sleeve means onto said outer tube;

said sleeve means comprises threaded nut means fixedly retained therewithin;

said tip body comprises a threaded portion threaded through said nut means;

said tip body comprises a further threaded portion for fixedly attaching said tip body to said first end of said inner tube, said first end of said inner tube having a threaded portion for receiving said further threaded portion of said tip body;

said tip body being configured to be adjustable within said sleeve means to adjust a position of said second end of said tip body with respect to said first end of said sleeve means upon turning of said inner tube within said outer tube;

said helical grooves have a pitch angle of about 25° to about 55°;

said blast pipe-tuyere arrangement comprises at least two of said lance means, each of said at least two lance means defining a longitudinal axis;

each of said at least two lance means being disposed angularly with respect to another of said at least two lance means;

at least a first and a second of said at least two lance means being disposed such that corresponding longitudinal axes of said at least a first and a second of said at least two lance means intersect within said first passage at an angle of intersection;

said angle of intersection being between about 150° to about 180°;

said helical grooves of each of said at least a first and a second of said at least two lance means are disposed counter-rotative to said helical grooves of the other of said at least a first and a second of said at least two lance means;

the blast furnace further comprises at least two of said blast pipe-tuyere arrangements;

said injection arrangement further comprises a common air duct for supplying the hot air to each of said at least two of said blast pipe-tuyere arrangements; and said lance means further comprises a thermoelement for monitoring a temperature of said lance means.

6. Lance means for injecting fuel and gas into a first passage of a blast pipe-tuyere arrangement of a blast furnace, the gas being for enhancing combustion of the fuel, said lance means having a first end disposed within the first passage, said lance means comprising:

an outer tube and an inner tube, the inner tube being disposed within the outer tube;

said inner and outer tubes defining a second passage between said inner and outer tubes, said second passage for conducting the gas into said first passage;

said inner tube defining a third passage therewithin, said third passage for conducting the fuel into said first passage;

tip means disposed at said first end of said lance means; and said tip means comprising:

a longitudinal bore therethrough, said longitudinal bore being disposed to provide a continuation of said third passage; and a plurality of helical passages separated from and disposed helically about said longitudinal bore, said helical passages being disposed to provide a continuation of said second passage.

7. The lance means according to claim 6, wherein:

said tip means comprises a one-piece tip body;

said longitudinal bore passes through said one-piece tip body;

said one-piece tip body has an exterior surface; and said helical passages comprises helical grooves disposed helically about said exterior surface of said one-piece tip body.

8. The lance means according to claim 7, wherein:

said helical grooves extend helically about said tip body through about 0.5 to about 1.5 turns.

9. The lance means according to claim 8, wherein:

said inner tube has a first end disposed adjacent said tip means;

said tip means has a first end disposed adjacent the first end of said inner tube, and a second end disposed opposite to the first end of said tip means;

said longitudinal bore comprises a mouth portion for expelling the fuel into said first passage, said mouth portion of said longitudinal bore being disposed at a first distance from said first end of said tip means;

said plurality of helical grooves comprises a terminal portion of said second passage, each of said plurality of helical grooves comprising corresponding mouth portions for expelling the gas into said first passage, said mouth portions of said helical grooves being disposed at a second distance from said first end of said tip means; and said first distance being greater than said second distance.

10. The lance means according to claim 9, wherein:

said inner tube is disposed concentrically within said outer tube;

said second passage comprises an annular space between said inner and outer tubes;

said one-piece tip body comprises a heat resistant material;

said longitudinal bore is configured for being substantially aligned with said third passage;

said plurality of helical grooves are disposed concentrically about said longitudinal bore;

said plurality of helical grooves comprise six helical grooves disposed in a spaced apart relationship about the exterior surface of said tip body;

the fuel comprises coal dust;

the gas comprises oxygen;

said lance means further comprises:

means for connecting said third passage to a coal dust supply source; and means for connecting said second passage to an oxygen supply source;

said tip means further comprises sleeve means for being disposed about said one-piece tip body;

said outer tube having a first end disposed adjacent said sleeve means, and said sleeve means providing a continuation of said outer tube;

said sleeve means having an interior surface disposed in contact with said exterior surface of said tip body;

said helical grooves being bordered by said interior surface of said sleeve means;

said sleeve means having a first end disposed away from said outer tube;

said tip body and said helical grooves extending a distance out of said first end of said sleeve means to define said mouth portions of said helical passages;

said mouth portions of said helical grooves are disposed in a radial direction away from said tip body;

said lance means further comprises, adjacent said first end thereof, means for maintaining the first end of said inner tube in a substantially fixed position with respect to the first end of the outer tube;

said lance means has a second end opposite to said first end of said lance means, and said lance means further comprises, adjacent said second end thereof, means for allowing relative axial expansion of said inner and outer tubes;

said means for allowing relative expansion comprising:

a first steel plate welded to said inner tube;

a second steel plate spaced apart from said first steel plate and welded to said outer tube;

a mantle disposed between and connecting said first steel plate and said second steel plate, said mantle being spaced a distance radially away from said inner and outer tubes;

said sleeve means is fixedly attached to said outer tube by one of:

a weld between said sleeve means and said outer tube; and threaded portions, wherein each of said outer tube and said sleeve means comprises corresponding threaded portions for threading said sleeve means onto said outer tube;

said sleeve means comprises threaded nut means fixedly retained therewithin;

said tip body comprises a threaded portion threaded through said nut means;

said tip body comprises a further threaded portion for fixedly attaching said tip body to said first end of said inner tube, said first end of said inner tube having a threaded portion for receiving said further threaded portion of said tip body;

said tip body being configured to be adjustable within said sleeve means to adjust a position of said second end of said tip body with respect to said first end of said sleeve means upon turning of said inner tube within said outer tube;

said helical grooves have a pitch angle of about 25° to about 55°; and said lance means further comprises a the thermoelement for monitoring a temperature of said lance means.

11. A method for injecting fuel and gas into a blast pipe-tuyere arrangement of a blast furnace, the blast pipe-tuyere arrangement defining a first passage therethrough, and the blast pipe-tuyere arrangement comprising lance means for injecting the fuel and gas into the first passage, said lance means having a first end disposed within the first passage, and said lance means comprising: an outer tube and an inner tube, the inner tube being disposed within the outer tube; said inner and outer tubes defining a second passage between said inner and outer tubes, said second passage being configured for conducting the gas into said first passage, the gas being for enhancing combustion of the fuel; said inner tube defining a third passage therewithin, said third passage being configured for conducting the fuel into said first passage; tip means disposed at the first end of said lance means, said tip means comprising: a longitudinal bore therethrough, said longitudinal bore being disposed to provide a continuation of said third passage; and a plurality of helical passages separated from and disposed helically about said longitudinal bore, said helical passages being disposed to provide a continuation of said second passage; and said method comprising the steps of:

providing said inner and outer tubes of said lance means;

configuring said inner and outer tubes to define said second passage between said inner and outer tubes and said third passage within said inner tube;

disposing said tip means at the first end of said lance means;

providing said longitudinal bore through said tip means;

providing said plurality of helical passages in said tip means helically about said longitudinal bore;

passing the fuel through the third passage of the inner tube;

passing the fuel through the longitudinal passage of the tip means;

passing the gas through the second passage between the inner and outer tubes;

passing the gas through the plurality of helical passages of the tip means;

inducing a swirling motion to the gas by passing the gas through the helical passages;

expelling the gas out of the helical passages in a swirling motion; and expelling the fuel out of the longitudinal passage into the swirling gas.

12. The method according to claim 11, wherein said tip means comprises a tip element, said tip element having a longitudinal axis, said longitudinal bore of said tip element being disposed along the longitudinal axis; each of said plurality of passages of said tip element comprise a terminal portion of said second passage, each of said plurality of passages comprising corresponding mouth portions for expelling the gas into said first passage, said mouth portions of said plurality of passages being disposed radially with respect to the longitudinal passage of said tip element to disperse the gas radially away from said tip element, and said method further comprises the steps of:

expelling the gas through said radially disposed mouth portions in a direction radially outward from said tip element.

13. The method according to claim 12, wherein said inner tube has a first end disposed adjacent said tip element, said tip element has a first end disposed adjacent the first end of said inner tube, and a second end disposed opposite to the first end of said tip element, said longitudinal bore comprises a mouth portion for expelling the fuel into said first passage, said mouth portion of said longitudinal bore being disposed at a first distance from the first end of said tip element, said mouth portions of said helical passages being disposed at a second distance from the first end of said tip means, said first distance being greater than said second distance, and said method further comprises the steps of:

disposing said mouth portion of the longitudinal bore at said first distance from the first end of said tip element;

disposing said mouth portions of said helical passages at said second distance from the first end of said tip element;

radially expelling the gas from said helical passages at said second distance; and expelling the fuel out of the longitudinal bore at said first distance further away from the first end of said tip element than said expelling of the gas at said second distance closer to the first end of said tip means.

14. The method according to claim 13, further comprising:

configuring said helical passages to extend about 0.5 to about 1.5 full turns about said tip element;

passing the gas through said about 0.5 to about 1.5 helical turns about said tip element to provide sufficient swirling of the gas upon said expelling of the gas and provide a substantial pressure drop of the gas at said mouth portions upon said expelling of the gas;

configuring said tip means as a one-piece tip body, the one-piece tip body having an exterior surface;

providing said longitudinal bore through said one-piece tip body;

providing said helical passages helically about said exterior surface of said one-piece tip body;

disposing said inner tube concentrically within said outer tube;

configuring said second passage as an annular space between said inner and outer tubes;

forming said one-piece tip body of a heat resistant material;

configuring said longitudinal bore for being substantially aligned with said third passage;

configuring said plurality of helical grooves as six helical grooves disposed in a spaced apart relationship about the exterior surface of said tip body;

supplying coal dust as the fuel;

supplying oxygen as the gas;

configuring said lance means to further comprise:

means for connecting said third passage to a coal dust supply source; and means for connecting said second passage to an oxygen supply source;

providing sleeve means for being disposed about said one-piece tip body;

configuring said outer tube to have a first end disposed adjacent said sleeve means, and said sleeve means providing a continuation of said outer tube;

disposing an interior surface of said sleeve means in contact with said exterior surface of said tip body;

configuring said helical grooves to be bordered by said interior surface of said sleeve means;

disposing a first end of said sleeve means away from said outer tube;

configuring said tip body and said helical grooves to extend a distance out of said first end of said sleeve means to define said mouth portions of said helical passages;

configuring said mouth portions of said helical grooves to be disposed in a radial direction away from said tip body;

configuring said lance means to further comprise, adjacent said first end thereof, means for maintaining the first end of said inner tube in a substantially fixed position with respect to the first end of the outer tube;

configuring said lance means to have a second end opposite to said first end of said lance means, said lance means further comprises, adjacent said second end thereof, means for allowing relative axial expansion of said inner and outer tubes;

configuring said means for allowing relative exapansion to comprise:

a first steel plate welded to said inner tube;

a second steel plate spaced apart from said first steel plate and welded to said outer tube;

a mantle disposed between and connecting said first steel plate and said second steel plate, said mantle being spaced a distance radially away from said inner and outer tubes;

fixedly attahing said sleeve means to said outer tube by one of:

welding said sleeve means to said outer tube; and threading together said sleeve means and said outer tube, wherein each of said outer tube and said sleeve means comprises corresponding threaded portions for threading said sleeve means onto said outer tube;

fixedly attaching threaded nut means within said sleeve means;

threading a threaded portion of said tip body through said nut means;

rotating said inner tube to turn said tip body within said nut means to adjust a size of said at least one mouth portion at least during injection of gas and fuel from said lance means into the blast pipe-tuyere arrangement to adjust at least one of:

an amount of gas expelled therefrom; and a dispersion of the gas expelled therefrom;

configuring said helical grooves at a pitch angle of about 25° to about 55° about said tip body; and disposing a thermoelement within said lance means to monitoring a temperature of said lance means.

15. Lance means for injecting fuel and gas into a first passage of a blast pipe-tuyere arrangement of a blast furnace, the gas being for enhancing combustion of the fuel, said lance means having a first end disposed within the first passage, and said lance means comprising:

an outer tube and an inner tube, the inner tube being disposed within the outer tube;

said inner and outer tubes defining a second passage between said inner and outer tubes, said second passage for conducting the gas into said first passage;

said inner tube defining a third passage therewithin, said third passage for conducting the fuel into said first passage;

tip means disposed at said first end of said lance means;

said tip means comprising:

a longitudinal bore therethrough, said longitudinal bore being disposed to provide a continuation of said third passage; and a plurality of passages separated from and disposed about said longitudinal bore, said plurality of passages being disposed to provide a continuation of said second passage;

said tip means have a longitudinal axis, said longitudinal bore of said tip means being disposed along the longitudinal axis;

said plurality of passages of said tip means comprise a terminal portion of said second passage, each of said plurality of passages comprising corresponding mouth portions for expelling the gas into said first passage, said mouth portions of said plurality of passages being disposed radially with respect to the longitudinal passage of said tip means to disperse the gas radially away from said tip means.

16. The lance means according to claim 15, wherein:

each of said plurality of passages comprises a helical passage disposed helically about said longitudinal bore;

each said helical passage extends helically about said longitudinal bore about 0.5 to about 1.5 turns.

17. The lance means according to claim 16, wherein:

said tip means comprises a one-piece tip body;

said longitudinal bore passes through said one-piece tip body;

said one-piece tip body having an exterior surface; and said helical passages comprising helical grooves disposed helically about said exterior surface of said one-piece tip body.

18. The lance means according to claim 17, wherein:

said inner tube has a first end disposed adjacent said tip body;

said tip body has a first end disposed adjacent the first end of said inner tube, and a second end disposed opposite to the first end of said tip body;

said longitudinal bore comprises a mouth portion for expelling the fuel into said first passage, said mouth portion of said longitudinal bore being disposed at a first distance from said first end of said tip body;

said mouth portions of said helical grooves being disposed at a second distance from said first end of said tip body;

said first distance being greater than said second distance;

said inner tube is disposed concentrically within said outer tube;

said second passage comprises an annular space between said inner and outer tubes;

said tip body comprises a heat resistant material;

said longitudinal bore is configured for being substantially aligned with said third passage;

said plurality of helical grooves being disposed concentrically about said longitudinal bore;

said plurality of helical grooves comprise six helical grooves disposed in a spaced apart relationship about the exterior surface of said tip body;

the fuel comprises coal dust;

the gas comprises oxygen;

said lance means further comprises:

means for connecting said third passage to a coal dust supply source; and means for connecting said second passage to an oxygen supply source;

said tip means further comprises sleeve means for being disposed about said one-piece tip body;

said outer tube having a first end disposed adjacent said sleeve means, and said sleeve means providing a continuation of said outer tube;

said sleeve means having an interior surface disposed in contact with said exterior surface of said tip body;

said helical grooves being bordered by said interior surface of said sleeve means;

said sleeve means having a first end disposed away from said outer tube;

said tip body and said helical grooves extending a distance out of said first end of said sleeve means to define said mouth portions of said helical passages;

said lance means further comprises, adjacent said first end thereof, means for maintaining the first end of said inner tube in a substantially fixed position with respect to the first end of the outer tube;

said lance means has a second end opposite to said first end of said lance means, and said lance means further comprises, adjacent said second end thereof, means for allowing relative axial expansion of said inner and outer tubes;

said means for allowing relative expansion comprising:

a first steel plate welded to said inner tube;

a second steel plate spaced apart from said first steel plate and welded to said outer tube;

a mantle disposed between and connecting said first steel plate and said second steel plate, said mantle being spaced a distance radially away from said inner and outer tubes;

said sleeve means is fixedly attached to said outer tube by one of:

a weld between said sleeve means and said outer tube; and threaded portions, wherein each of said outer tube and said sleeve means comprise corresponding threaded portions for threading said sleeve means onto said outer tube;

said sleeve means comprises threaded nut means fixedly retained therewithin;

said tip body comprises a threaded portion threaded through said nut means;

said tip body comprises a further threaded portion for fixedly attaching said tip body to said first end of said inner tube, said first end of said inner tube having a threaded portion for receiving said further threaded portion of said tip body;

said tip body being configured to be adjustable within said sleeve means to adjust a position of said second end of said tip body with respect to said first end of said sleeve means upon turning of said inner tube within said outer tube;

said helical grooves have a pitch angle of about 25° to about 55°; and said lance means further comprises a thermoelement for monitoring a temperature of said lance means.

19. Lance means for injecting fuel and gas into a first passage of a blast pipe-tuyere arrangement of a blast furnace, the gas being for enhancing combustion of the fuel, said lance means having a first end disposed within the first passage, and said lance means comprising:

an outer tube and an inner tube, said inner tube being disposed within said outer tube;

said inner and outer tubes defining a second passage between said inner and outer tubes, said second passage for conducting the gas into said first passage;

said inner tube defining a third passage therewithin, said third passage for conducting the fuel into said first passage;

tip means disposed at said first end of said lance means, said tip means comprising:

a longitudinal bore therethrough, said longitudinal bore being disposed to provide a continuation of said third passage; and a plurality of passages separated from and disposed about said longitudinal bore, said plurality of passages being disposed to provide a continuation of said second passage;

each of said plurality of passages comprising a terminal portion of said second passage, each of said plurality of passages comprising corresponding mouth portions for expelling the gas into said first passage; and said lance means comprising means for adjusting a size of at least one of said mouth portions of said plurality of passages to adjust dispersion of the gas expelled therefrom.

20. The lance means according to claim 19, wherein said means for adjusting comprises means for adjusting the size of at least one mouth portion while said first end of said lance means is disposed within said first passage.

21. The lance means according to claim 20, wherein:

said tip means comprises a one-piece tip body;

said outer tube has a first end disposed about said tip body;

said inner tube has a first end disposed adjacent said tip body;

said tip body being fixedly attached to said inner tube at said first end of said inner tube;

said tip body has a first end disposed adjacent the first end of said inner tube, and a second end disposed opposite to the first end of said tip means, said second end of said tip body protruding from said first end of said outer tube;

said outer tube comprises threaded nut means disposed therewithin;

said tip body comprises a threaded portion threaded through said nut means;

said means for adjusting comprises said threaded nut means within said outer tube and said tip body fixedly attached to said inner tube; and said tip body being rotatable within said nut means to adjust a position of said second end of said tip body with respect to said first end of said outer tube upon turning of said inner tube within said outer tube.

22. The lance means according to claim 21, wherein:

each of said plurality of passages comprise a helical passage disposed helically about said longitudinal bore;

each said helical passage extends helically about said longitudinal bore about 0.5 to about 1.5 turns;

said longitudinal bore passes through said one-piece tip body;

said one-piece tip body has an exterior surface;

said helical passages comprise helical grooves disposed helically about said exterior surface of said one-piece tip body;

said longitudinal bore comprises a mouth portion for expelling the fuel into said first passage, said mouth portion of said longitudinal bore being disposed at a first distance from said first end of said tip body;

said plurality of helical grooves comprise a terminal portion of said second passage;

said mouth portions of said helical grooves being disposed at a second distance from said first end of said tip body;

said first distance being greater than said second distance;

said inner tube is disposed concentrically within said outer tube;

said second passage comprises an annular space between said inner and outer tubes;

said tip body comprises a heat resistant material;

said longitudinal bore is configured for being substantially aligned with said third passage;

said plurality of helical grooves being disposed concentrically about said longitudinal bore;

the fuel comprises coal dust;

the gas comprises oxygen;

said lance further comprises:

means for connecting said third passage to a coal dust supply source; and means for connecting said second passage to an oxygen supply source;

said outer tube further comprises sleeve means for being disposed about said tip body;

said outer tube having a first end disposed adjacent said sleeve means, and said sleeve means providing a continuation of said outer tube;

said nut means is disposed within said sleeve means;

said sleeve means having an interior surface disposed in contact with said exterior surface of said tip body;

said helical grooves being bordered by said interior surface of said sleeve means;

said sleeve means having a first end disposed away from said outer tube;

said tip body and said helical grooves extending a distance out of said first end of said sleeve means to define said mouth portions of said helical passages;

said mouth portions of said helical grooves being disposed in a radial direction away from said tip body;

said lance means further comprises, adjacent said first end thereof, means for maintaining the first end of said inner tube in a substantially fixed position with respect to the first end of the outer tube;

said lance means has a second end opposite to said first end of said lance means, and said lance means further comprises, adjacent said second end thereof, means for allowing relative axial expansion of said inner and outer tubes;

said means for allowing relative expansion comprising:

a first steel plate welded to said inner tube;

a second steel plate spaced apart from said first steel plate and welded to said outer tube;

a mantle disposed between and connecting said first steel plate and said second steel plate, said mantle being spaced a distance radially away from said inner and outer tubes;

said helical grooves have a pitch angle of about 25° to about 55°; and said lance means further comprises a thermoelement for monitoring a temperature of said lance means.

23. The lance means according to claim 6, further comprising adjacent said tip means, for maintaining the first end of said inner tube in a substantially fixed position with respect to the outer tube.

24. The lance means according to claim 7, wherein:

said outer tube has a tube portion disposed about said tip body;

said tube portion of said outer tube has an interior surface disposed in contact with said exterior surface of said tip body; and said helical grooves are bordered by said interior surface of said tube portion of said outer tube.

25. The lance means according to claim 24, wherein:

said plurality of helical grooves comprise a terminal portion of said second passage, each of said plurality of helical grooves comprising corresponding mouth portions for expelling the gas into said first passage;

said tip body and said helical grooves extend a distance out of said tube portion of said outer tube to define said mouth portions of said plurality of helical passages.

26. The injection arrangement according to claim 1, wherein:

said blast pipe-tuyere arrangement comprises at least two of said lance means, each of said at least two lance means defining a longitudinal axis; and each of said at least two lance means being disposed angularly with respect to another of said at least two lance means.

27. The injection arrangement according to claim 26, wherein:

said tip means comprises a one-piece tip body;

said one-piece tip body has an exterior surface;

said helical passages of each of said at least two lance means comprise helical grooves disposed helically about said exterior surface of said one-piece tip body;

said at least two lance means comprise at least a first and a second of said at least two lance means; and said helical grooves of each of said at least a first and a second of said at least two lance means are disposed counter-rotative to said helical grooves of the other of said at least a first and a second of said at least two lance means.

* * * * *